US010906076B2

(12) United States Patent
Wang et al.

(10) Patent No.: US 10,906,076 B2
(45) Date of Patent: Feb. 2, 2021

(54) METHOD FOR ROLLING METAL WIRE OR ROD WITH ASSISTANCE OF COMBINED STATIC MAGNETIC FIELD

(71) Applicant: JIANGSU UNIVERSITY, Jiangsu (CN)

(72) Inventors: Hongming Wang, Zhenjiang (CN); Guirong Li, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 316 days.

(21) Appl. No.: 15/744,076

(22) PCT Filed: Apr. 23, 2016

(86) PCT No.: PCT/CN2016/080088

§ 371 (c)(1),
(2) Date: Jan. 12, 2018

(87) PCT Pub. No.: WO2017/028552

PCT Pub. Date: Feb. 23, 2017

(65) Prior Publication Data

US 2018/0200767 A1 Jul. 19, 2018

(30) Foreign Application Priority Data

Aug. 17, 2015 (CN) ..... 2015 1 0503150

(51) Int. Cl.

| | |
|---|---|
| ***B21B 1/18*** | (2006.01) |
| ***C21D 10/00*** | (2006.01) |
| ***B21B 1/42*** | (2006.01) |
| ***B21B 39/06*** | (2006.01) |
| ***B21B 1/46*** | (2006.01) |
| ***B21C 37/04*** | (2006.01) |

(Continued)

(52) U.S. Cl.

CPC ..... *B21B 1/18* (2013.01); *B21B 1/42* (2013.01); *B21B 9/00* (2013.01); *B21B 39/06* (2013.01);

(Continued)

(58) Field of Classification Search

CPC .. B21B 1/18; B21B 1/42; B21D 26/06; B21D 26/14; C21D 1/04; C22F 3/02

(Continued)

(56) References Cited

U.S. PATENT DOCUMENTS 4,044,584 A 8/1977 Korshunov
8,545,645 B2 * 10/2013 Stebbing ..... C21D 1/84 148/558

(Continued)

FOREIGN PATENT DOCUMENTS

CN 1135383 A 11/1996
CN 102179404 A 9/2011

(Continued)

OTHER PUBLICATIONS

Translation—Li —CN103643190A—Translated May 2020 (Year: 2014).*

*Primary Examiner* — Debra M Sullivan
*Assistant Examiner* — Matthew Kresse
(74) *Attorney, Agent, or Firm* — Soroker Agmon Nordman PTE Ltd

(57) ABSTRACT

The present invention relates to the technical field of extruding, rolling and drawing metal wire or rod with assistance of a combined static magnetic field, characterized by providing, in a moving direction of a metal wire or rod, a gradient static magnetic field generated by a combination of a permanent magnet and a steady electromagnet; and after a raw material for rolling the metal wire or rod is processed by the gradient static magnetic field, performing rolling extrusion and pulling on the material. For multiple passes of rolling extrusion and pulling, the static magnetic field processing is performed before each pass of rolling.

5 Claims, 1 Drawing Sheet

(51) Int. Cl.
*B21B 9/00* (2006.01)
*C22F 1/057* (2006.01)

(52) U.S. Cl.
CPC ..... *C21D 10/00* (2013.01); *B21B 1/463* (2013.01); *B21C 37/047* (2013.01); *C22F 1/057* (2013.01)

(58) Field of Classification Search
USPC ..... 72/430
See application file for complete search history.

(56) References Cited

U.S. PATENT DOCUMENTS

| | | | | |
|---|---|---|---|---|
| 2002/0182557 | A1* | 12/2002 | Kuriyama | C21D 1/04 432/124 |
| 2005/0247098 | A1* | 11/2005 | Witte | B21C 1/30 72/287 |
| 2010/0212856 | A1* | 8/2010 | Rosenthal | C21D 8/0426 164/493 |
| 2011/0056649 | A1* | 3/2011 | Hohenbichler | B22D 11/1206 164/460 |
| 2013/0140300 | A1* | 6/2013 | Cummings | H05B 6/108 219/672 |

FOREIGN PATENT DOCUMENTS

| | | | | |
|---|---|---|---|---|
| CN | 102211153 | A | | 10/2011 |
| CN | 103643190 | A | * | 3/2014 |
| CN | 103643190 | A | | 3/2014 |
| CN | 105032926 | A | | 11/2015 |
| JP | S61130475 | A | | 6/1986 |

* cited by examiner

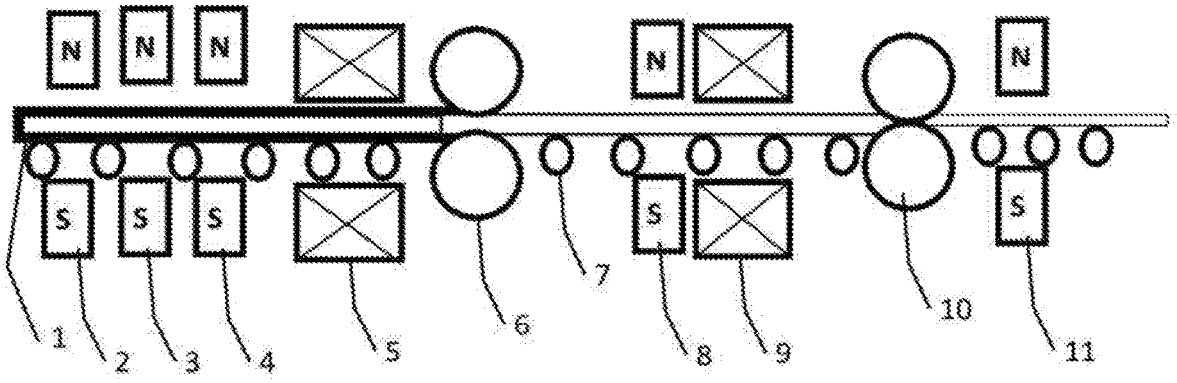
N
N
N
N
N
S
S
S
S
S
1
2
3
4
5
6
7
8
9
10
11

METHOD FOR ROLLING METAL WIRE OR ROD WITH ASSISTANCE OF COMBINED STATIC MAGNETIC FIELD

FIELD OF THE INVENTION

The present invention mainly relates to the technical field of extruding, rolling and drawing metal wire or rod, in particular to a method for rolling metal wire or rod with assistance of combined static magnetic field.

BACKGROUND OF THE INVENTION

Metal wire or rod is an important material for engineering machinery, and are mainly produced and formed by rolling, extruding, and drawing. Owing to the fact that many metal materials have high deformation resistance, high energy is consumed when those metal materials are rolled, extruded, or drawn into metal wire or rod; especially, the production of metal wire or rod from high-strength metal materials have high processing difficulty, low dimension accuracy, and low yield; besides, in the rolling, extruding and drawing process of a metal material, the blank for metal wire or rod is heated up to a high temperature so that the metal can be easily deformed and processed; however, for some active metal materials, such as aluminum, magnesium, titanium, etc., oxidation and embrittlement in the process of high-temperature processing can severely degraded the quality of the finished product.

In the prior art, the Chinese Patent No. CN103628010A has disclosed a photo-magnetic coupling method for improving the plastic deformation capability of aluminum-based composite materials. The method involves coupling between photons and a magnetic field for 20 to 200 seconds and can improve the plastic deformation capability of aluminum-based composite materials. However, the drawbacks of the method include: the photo-magnetic coupling is complex, and it is difficult to achieve an optimal parameter matching effect; especially, the method is not suitable for a high-speed continuous extruding, rolling and drawing process of metal wire or rod, because it requires a long photo-magnetic coupling time. The Chinese Patent No. CN103643190A has disclosed a method for improving the deformation capability of aluminum-based composite materials, in which a 1 T-50 T DC static magnetic field is applied to an aluminum-based composite material for 30 to 200 seconds to improve the plastic deformation capability of the aluminum-based composite material. However, the method is also not suitable for high-speed metal wire or rod rolling, because it employs a strong DC magnetic field, especially requires long-time processing of the composite material in the magnetic field.

Hence, in order to decrease the deformation resistance and reduce energy consumption in the processing process of metal wire or rod, while improving the rolling, extruding and drawing efficiency of the metal wire or rod, the dimension accuracy and yield of finished products, a method for rolling metal wire or rod with assistance of combined static magnetic field is provided.

SUMMARY OF THE INVENTION

The object of the present invention is to realize high-speed, high-accuracy and high-yield processing of metal wire or rod in a high-speed rolling, extruding and drawing process of metal wire or rod with assistance of a static magnetic field, utilizing the magnetic field to decrease the deformation resistance in the material processing process and reduce the adverse effect of work-hardening to further processing of the material, so as to solve the problems caused by high material deformation resistance and work-hardening in high-speed processing process of the metal wire or rod in the prior art and overcome the drawbacks of low efficiency, high difficulty and complex process for improving material plasticity in the prior art.

The object of the present invention is attained with the following technical scheme: a method for rolling metal wire or rod with assistance of combined static magnetic field, characterized in that, a static magnetic field is arranged in the travel direction of a blank of metal wire or rod, the blank of metal wire or rod is subjected to the effect of the magnetic field when it passes through the area of the static magnetic field before the blank of metal wire or rod is rolled, extruded and drawn, the longitudinal center line of the blank of metal wire or rod is kept in line with the travel direction thereof, the blank is rolled, extruded and drawn by rollers after it is treated with assistance of the static magnetic field; the static magnetic field disposed for a first pass of rolling (i.e. initial rolling) is a gradient magnetic field formed by three groups of permanent magnets and a group of steady electromagnets that are disposed in parallel along the travel direction of the blank of metal wire or rod; among the three groups of permanent magnets, the magnetic induction intensity of the first group of permanent magnets is 0.01-0.30 T, and the width of the first group of permanent magnets in the travel direction of the blank of metal wire or rod (i.e., the width of action zone) is 0.1-1.0 m; the magnetic induction intensity of the second group of permanent magnets is 0.31-0.60 T, and the width of the second group of permanent magnets in the travel direction of the blank of metal wire or rod (i.e., the width of action zone) is 0.1-1.0 m; the magnetic induction intensity of the third group of permanent magnets is 0.61-0.99 T, and the width of the third group of permanent magnets in the travel direction of the blank of metal wire or rod (i.e., the width of action zone) is 0.1-1.0 m; the steady electromagnet is an annular DC superconducting magnet, the magnetic induction intensity thereof is 1.01-3.00 T, the central axis thereof is in the same line as the central axis of the blank of metal wire or rod, and the width thereof in the travel direction of the blank of metal wire or rod (i.e., the width of action zone) is 0.1-1.0 m.

Furthermore, for multiple passes of rolling, extruding and drawing, the blank is treated in a static magnetic field before each pass of rolling, extruding and drawing.

For arranging static magnetic field in the travel direction of the blank of metal wire or rod, the static magnetic field arranged for the second pass of rolling is a gradient magnetic field formed by a group of permanent magnets and a steady electromagnet that are disposed in parallel in the travel direction of the blank of metal wire or rod; the magnetic induction intensity of the permanent magnets is 0.51-0.99 T, and the width of the permanent magnets in the travel direction of the blank of metal wire or rod (i.e., the width of action zone) is 0.5-1.0 m; the steady electromagnet is an annular DC superconducting magnet, the magnetic induction intensity thereof is 1.01-3.00 T, the central axis thereof is in the same line as the central axis of the blank of metal wire or rod, and the width thereof in the travel direction of the blank of metal wire or rod (i.e., the width of action zone) is 0.1-1.0 m.

For arranging static magnetic field in the travel direction of the blank of metal wire or rod, the static magnetic field arranged for multiple passes of rolling after the second pass of rolling is a magnetic field formed by a group of permanent magnets; the magnetic induction intensity of the permanent magnets is 0.31-0.75 T, and the width of the permanent magnets in the travel direction of the blank of metal wire or rod (i.e., the width of action zone) is 0.5-1.0 m.

When the static magnetic field is a magnetic field generated by permanent magnets, the permanent magnet may be a U-shaped magnet or a circular magnet; in case that a U-shaped magnet is used, the longitudinal center line of the blank of metal wire or rod is in the same line as the center line of the notch of the U-shaped magnet; in case that a circular magnet is used, the longitudinal center line of the blank of metal wire or rod is in the same line as the center line of the circular magnet.

The method provided in the present invention is especially suitable for extruding, rolling and drawing of non-magnetic metal wire or rod. For the existing metal wire or rod production method, the method provided in the present invention does not require modification to the existing heating, soaking, and controlled rolling and controlled cooling methods, and does not require any additional material processing procedure; rather, the method provided in the present invention only requires disposing a static magnetic field device on a conveying track for the blank of metal wire or rod and the intermediate product, and controlling the blank of metal wire or rod or the intermediate product to pass through the magnetic field in the normal conveying process; thus, the deformation resistance of the material can be decreased, the plastic deformation capability of the material can be improved, and thereby a purpose for improving the dimension accuracy and yield of finished product and reducing processing defects can be attained.

The method provided in the present invention has the following advantages:

1) Compared with the existing method in which no magnetic field is applied, with the method provided in the present invention, the deformation resistance of the material is decreased, the plastic deformation capability of the material is improved, and the dimension accuracy and yield of the finished product are improved; besides, the energy consumption in the processing process is reduced, and the defects caused by work hardening of the product are reduced. It is proved with existing data: for copper, magnesium, titanium, and alloys thereof, with the method provided in the present invention, the deformation resistance of the material is decreased by 40-100 MPa; thus, for plastic processing of the materials, any brittle failure in the processing process is eliminated essentially, the yield of finished product is improved, and the defects are reduced remarkably.
2) Compared with the electro-plastic method in the prior art, the method provided in the present invention is simpler, safer, and more efficient. The electro-plastic method requires applying pulse current in the blank, which introduces certain potential safety hazard in the metal processing process; in contrast, the method provided in the present invention employs a magnetic field formed by permanent magnets, which does not involve any additional energy consumption, and has advantages including environmental protection, high safety, and energy-saving; the DC superconducting magnetic field employed by the method provided in the present invention has advantages including non-contact, high safety, and energy-saving.
3) The method provided in the present invention is simple, does not require any additional metal material processing procedure, does not affect the continuousness of the existing production process and method, and has advantages including low investment and low operation cost.

BRIEF DESCRIPTION OF DRAWINGS

FIG. 1 is a schematic view of the rolling principle in the present invention.

In the FIGURES:

1—blank to be rolled; 2—first group of permanent magnets; 3—second group of permanent magnets; 4—third group of permanent magnets; 5—steady electromagnet for initial rolling; 6—roller for first pass of rolling; 7—conveying roller; 8—fourth group of permanent magnets; 9—steady electromagnet for second pass of rolling; 10—roller for second pass of rolling; 11—permanent magnet after second pass of rolling

DESCRIPTION OF PREFERRED EMBODIMENTS

Example 1: Extruding and Drawing of Copper

An oxygen-free copper blank having a diameter of 18 cm is obtained with a line-frequency induction smelting furnace through semi-continuous casting and is used as a blank for copper extruding and drawing in this example.

A continuous extruding process is used to produce a copper wire, and the main steps are as follows: the oxygen-free copper blank is heated up to 650° C. first, and then is loaded into a conveying roller track, where the oxygen-free copper blank is to be fed into an extruder for a first pass of rolling; a gradient magnetic field formed by three groups of U-shaped permanent magnets and a group of steady electromagnets is disposed on the conveying roller track in front of the extruder; in this example, the magnetic induction intensity of the first group of permanent magnets is 0.25 T, and the width of the first group of permanent magnets in the travel direction of the blank of metal wire or rod (i.e., the width of action zone) is 0.5 m; the magnetic induction intensity of the second group of permanent magnets is 0.50 T, and the width of the second group of permanent magnets in the travel direction of the blank of metal wire or rod (i.e., the width of action zone) is 1.0 m; the magnetic induction intensity of the third group of permanent magnets is 0.85 T, and the width of the third group of permanent magnets in the travel direction of the blank of metal wire or rod (i.e., the width of action zone) is 0.1 m; the steady electromagnet is an annular DC superconducting magnet, with 2.0 T magnetic induction intensity; the permanent magnets are mounted at appropriate positions to ensure that the longitudinal center line of the copper blank is in the same line as the center line of the notches of the U-shaped magnets, the steady electromagnet is mounted at an appropriate position to ensure that the central axis of the steady electromagnet is in the same line as the central axis of the blank of metal wire or rod, and the width of the steady electromagnet in the travel direction of the blank of metal wire or rod (i.e., the width of action zone) is 0.2 m.

After the oxygen-free copper blank is treated in the above-mentioned magnetic field, it is fed into a continuous extruder and extruded into copper wire, wherein the rotation speed of the continuous extruder is 15 r/min, the extrusion speed of the copper wire is 20 m/min, the temperature of the copper wire is 600° C. in the extrusion process, and the pressure in the extrusion cavity is 1100 MPa; in addition, the copper wire extruded from the mold is cooled in a vacuum water-cooling device, i.e., the copper wire extruded at a high temperature is cooled in a vacuum tube; thus, the copper wire is isolated from oxygen in the entire deformation process to avoid oxygen absorption and ensure low-oxygen content in the copper wire; after the copper wire is extruded from the mold, it is cooled in an anti-oxidation vacuum tube and a water tank, and blow-dried to 25° C.; the obtained copper wire is in diameter of Φ10 mm.

The obtained oxygen-free copper wire in Φ10 mm diameter is drawn into a fine copper wire by multiple passes of drawing; here, the copper wire is drawn by two passes: the copper wire is drawn from Φ10 mm diameter to Φ2 mm diameter in the first pass of drawing; in this process, the copper wire is treated in a magnetic field described in the present invention before drawing; the magnetic field used for the first pass of drawing, i.e. the static magnetic field disposed for the second pass of rolling in the present invention, is a gradient magnetic field formed by a group of permanent magnets and a steady electromagnet which are disposed in parallel; the permanent magnets are circular magnets, the magnetic induction intensity of the permanent magnets is 0.75 T, and the width of the permanent magnets in the travel direction of the blank of metal wire or rod (i.e., the width of action zone) is 0.75 m; the steady electromagnet is an annular DC superconducting magnet, the magnetic induction intensity thereof is 3.00 T, the central axis of the permanent magnets and the steady electromagnet is in the same line as the central axis of the blank of metal wire or rod, and the width of the steady electromagnet in the travel direction of the blank of metal wire or rod (i.e., the width of action zone) is 0.1 m; the copper wire in Φ2 mm diameter is drawn into a fine copper wire in Φ0.2 mm diameter in the second pass of drawing; in this process, the copper wire is treated in a magnetic field formed by a group of circular permanent magnets before the second drawing; the magnetic induction intensity of the permanent magnets is 0.55 T, the width of the permanent magnets in the travel direction of the blank of metal wire or rod (i.e., the width of action zone) is 0.5 m, and the longitudinal center line of the copper wire is in the same line as the center line of the circular magnets.

Thus, a copper rod in Φ18 cm diameter is extruded into a copper wire in Φ10 mm diameter. In the process of twice drawing into a copper wire in Φ0.2 mm diameter, on a premise that all other processing conditions are the same, it can been seen by comparing the method in which a magnetic field described in the present invention is applied and the method in which the magnetic field is not applied that: with the method provided in the present invention, the extruding and drawing efficiency is improved; especially, a broken wire phenomenon in the drawing process is completely eliminated; in the process of extruding the round blank into a wire, the surface smoothness of the obtained wire is improved, any burr, chamfer or tiny crack of the material is completely eliminated, and the dimension accuracy of the finished product is improved; in addition, with the method provided in the present invention, only a non-contact external field has to be applied on the conveying roller track and in the drawing process, and the continuousness of the original production process is not affected. The method provided in the present invention is safe and simple.

Example 2: Extruding and Drawing of Copper

An oxygen-free copper blank having a diameter of 20 cm is obtained with a line-frequency induction smelting furnace through semi-continuous casting and is used as a blank for copper extruding and drawing in this example;

A continuous extruding and drawing process is used to produce a super-fine copper wire, and the main steps are as follows: the oxygen-free copper blank is heated up to 650° C. first, and then is loaded into a conveying roller track, where the oxygen-free copper blank is to be fed into an extruder for a first pass of rolling; a gradient magnetic field formed by three groups of U-shaped permanent magnets and a group of steady electromagnets is disposed on the conveying roller track in front of the extruder; in this example, the magnetic induction intensity of the first group of permanent magnets is 0.30 T, and the width of the first group of permanent magnets in the travel direction of the blank of metal wire or rod (i.e., the width of action zone) is 0.5 m; the magnetic induction intensity of the second group of permanent magnets is 0.60 T, and the width of the second group of permanent magnets in the travel direction of the blank of metal wire or rod (i.e., the width of action zone) is 0.5 m; the magnetic induction intensity of the third group of permanent magnets is 0.99 T, and the width of the third group of permanent magnets in the travel direction of the blank of metal wire or rod (i.e., the width of action zone) is 0.5 m; the steady electromagnet is an annular DC superconducting magnet, with 3.0 T magnetic induction intensity; the permanent magnets are mounted at appropriate positions to ensure that the longitudinal center line of the copper blank is in the same line as the center line of the notches of the U-shaped magnets, the steady electromagnet is mounted at an appropriate position to ensure that the central axis of the steady electromagnet is in the same line as the central axis of the blank of metal wire or rod, and the width of the steady electromagnet in the travel direction of the blank of metal wire or rod (i.e., the width of action zone) is 0.1 m.

After the oxygen-free copper blank is treated in the above-mentioned magnetic field, it is loaded into a continuous extruder and extruded into a copper wire, wherein, the rotation speed of the continuous extruder is 15 r/min, the extrusion speed of the copper wire is 20 m/min, the temperature of the copper wire is 620° C. in the extrusion process, and the pressure in the extrusion cavity is 1200 MPa; in addition, the copper wire extruded from the mold is cooled in a vacuum water-cooling device, i.e., the copper wire extruded at a high temperature is cooled in a vacuum tube; thus, the copper wire is isolated from oxygen in the entire deformation process to avoid oxygen absorption and ensure low-oxygen content in the copper wire; after the copper wire is extruded from the mold, it is cooled in an anti-oxidation vacuum tube and a water tank, and blow-dried to 25° C.; the obtained copper wire is in diameter of Φ10 mm.

The obtained oxygen-free copper wire in Φ10 mm diameter is drawn into a super-fine copper wire by multiple passes of drawing; here, the copper wire is drawn for three passes: the copper wire is drawn from Φ10 mm diameter to Φ1.2 mm diameter in the first pass of drawing; in this process, the copper wire is treated in a magnetic field described in the present invention before drawing; the magnetic field used for the first pass of drawing, i.e. the static magnetic field disposed for the second pass of rolling in the present invention, is a gradient magnetic field formed by a group of permanent magnets and a steady electromagnet which are disposed in parallel; the permanent magnets are circular magnets, the magnetic induction intensity of the permanent magnets is 0.99 T, and the width of the permanent magnets in the travel direction of the blank of metal wire or rod (i.e., the width of action zone) is 0.50 m; the steady electromagnet is an annular DC superconducting magnet, the magnetic induction intensity thereof is 1.0 T, the central axes of the permanent magnets and the central axis of the steady electromagnet are in the same line as the central axis of the blank of metal wire or rod, and the width of the steady electromagnet in the travel direction of the blank of metal wire or rod (i.e., the width of action zone) is 0.1 m; the copper wire in Φ1.2 mm diameter is drawn into a fine copper wire in Φ0.1 mm diameter in the second pass of drawing; in this process, the copper wire is treated in a magnetic field formed by a group of circular permanent magnets before drawing; the magnetic induction intensity of the permanent magnets is 0.50 T, the width of the permanent magnets in the travel direction of the blank of metal wire or rod (i.e., the width of action zone) is 0.5 m, and the longitudinal center line of the copper wire is in the same line as the center lines of the circular magnets; the copper wire in Φ0.1 mm diameter is drawn into a super-fine copper wire in Φ0.02 mm diameter in the third pass of drawing; in this process, the copper wire is treated in a magnetic field formed by a group of circular permanent magnets before drawing; the magnetic induction intensity of the permanent magnets is 0.31 T, the width of the permanent magnets in the travel direction of the blank of metal wire or rod (i.e., the width of action zone) is 0.51 m, and the longitudinal center line of the copper wire is in the same line as the center lines of the circular magnets.

On a premise that all other processing conditions are the same, it can been seen by comparing the method in which a magnetic field described in the present invention is applied and a method in which the magnetic field is not applied that: with the method provided in the present invention, the extruding and drawing efficiency is improved; especially, a broken wire phenomenon in the drawing process is completely eliminated; in the process of extruding the round blank into a wire, the surface smoothness of the obtained wire is improved, any burr, chamfer or tiny crack of the material is completely eliminated, and the dimension accuracy of the finished product is improved, in addition, with the method provided in the present invention, only a non-contact external field has to be applied on the conveying roller track and in the drawing process, and the continuousness of the original production process is not affected. The method provided in the present invention is safe and simple.

Example 3: Extrusion of a Magnesium Alloy Rod

A deformation magnesium alloy cast ingot in Φ200 mm diameter is preheated to 350° C. and then placed on a conveying roller track where a static magnetic field is applied, an extrusion mold is preheated to 350° C., and the magnesium alloy cast ingot is extruded by the metal extruder into a rod in Φ10 mm diameter, wherein, the extrusion temperature is 380° C., the extrusion speed is 0.5 m/min, and the extrusion ratios in two passes are 10:1 and 2:1 respectively; the static magnetic field disposed for the first pass of extrusion is a gradient magnetic field formed by three groups of circular permanent magnets and a group of steady electromagnets that are disposed in parallel, wherein, the magnetic induction intensity of the first group of permanent magnets is 0.20 T, and the width of the first group of permanent magnets in the travel direction of the blank of metal wire or rod (i.e., the width of action zone) is 0.20 m; the magnetic induction intensity of the second group of permanent magnets is 0.40 T, and the width of the second group of permanent magnets in the travel direction of the blank of metal wire or rod (i.e., the width of action zone) is 0.20 m; the magnetic induction intensity of the third group of permanent magnets is 0.65 T, and the width of the third group of permanent magnets in the travel direction of the blank of metal wire or rod (i.e., the width of action zone) is 0.20 m; the center lines of the three groups of circular magnets are in the same line as the longitudinal center line of the magnesium alloy cast ingot; the steady electromagnet is an annular DC superconducting magnet, the magnetic induction intensity thereof is 1.20 T, the central axis thereof is in the same line as the central axis of the blank of metal wire or rod, and the width thereof in the travel direction of the blank of metal wire or rod (i.e., the width of action zone) is 0.20 m; the static magnetic field disposed for the second pass of extrusion is a gradient magnetic field formed by a group of circular permanent magnets and a steady electromagnet that are disposed in parallel, wherein, the magnetic induction intensity of the permanent magnets is 0.80 T, and the width of the permanent magnets in the travel direction of the blank of metal wire or rod (i.e., the width of action zone) is 0.5 m; the steady electromagnet used before the second pass of extrusion is an annular DC superconducting magnet, the magnetic induction intensity thereof is 1.60 T, the central axis thereof is in the same line as the central axis of the blank of metal wire or rod, and the width thereof in the travel direction of the blank of metal wire or rod (i.e., the width of action zone) is 0.20 m.

By comparing tensile properties at normal temperature of the above-mentioned rod obtained by extrusion and a rod obtained by extrusion from the same raw material with the same extrusion parameters but without applying a magnetic field, it can been seen that: with the method provided in the present invention, the tensile properties of the material are better, including: elongation at break $\delta$=25.6%, tensile strength $\sigma_b$=284.3 MPa, yield strength $\sigma_{0.2}$=187.5 MPa; in contrast, with the other method, the tensile properties of the material are: elongation at break $\delta$=22.6%, tensile strength $\sigma_b$=264.9 MPa, and yield strength $\sigma_{0.2}$=177.1 MPa. Besides, in terms of the appearance of the material, the magnesium alloy rod obtained with the method provided in the present invention has better surface smoothness, and has no burr or tiny crack which indicates that the method provided in the present invention can improve the appearance quality and properties of the extruded rod.

The invention claimed is:

1. A method of preparing metal wires or rods with assistance of a static magnetic field, comprising:

loading a blank in the form of a metal wire or rod into a conveying roller track to be processed by multiple stages of rolling, extruding or drawing along a travel direction of the blank;

subjecting the blank to an effect of a static magnetic field before being processed by each of the multiple stages of rolling, extruding or drawing;

wherein in the conveying roller track a longitudinal center line of the blank is kept in line with the travel direction of the blank;

wherein before a first stage of rolling, extruding or drawing, the blank is subject to magnetic treatment by a gradient static magnetic field formed by three groups of permanent magnets and a steady electromagnet that are disposed in parallel along the travel direction of the blank on the conveying roller track; and wherein a magnetic induction intensity of the three groups of permanent magnets increases from group to group along the travel direction of the blank.

2. The method of claim 1, wherein the magnetic induction intensity of a first group of the three groups of permanent magnets is 0.01-0.30 T, and a width of the first group the three groups of permanent magnets is 0.1-1.0 m in the travel direction of the blank; the magnetic induction intensity of a second group of the three groups of permanent magnets is 0.31-0.60 T, and a width of the second group of the three groups of permanent magnets is 0.1-1.0 m in the travel direction of the blank; the magnetic induction intensity of a third group of the three groups of permanent magnets is 0.61-0.99 T, and a width of the third group of the three groups of permanent magnets in the travel direction of the blank is 0.1-1.0 m; the steady electromagnet is an annular DC superconducting magnet, the magnetic induction intensity thereof is 1.01-3.00 T and a width thereof in the travel direction of the blank is 0.1-1.0 m.

3. The method of claim 2, wherein before a second stage of rolling, extruding or drawing, the blank is subject to magnetic treatment by a gradient static magnetic field formed by a fourth group of permanent magnets and an electromagnet; the magnetic induction intensity of the fourth group of permanent magnets is 0.51-0.99 T, and a width of the fourth group of permanent magnets in the travel direction of the blank is 0.5-1.0 m; the electromagnet configured to be used for the second stage is an annular DC superconducting magnet, the magnetic induction intensity thereof is 1.01-3.00 T and a width thereof in the travel direction of the blank is 0.1-1.0 m.

4. The method of claim 3, wherein after a second stage of rolling, extruding or drawing, the blank is subject to magnetic treatment by a gradient static magnetic field formed by a fifth group of permanent magnets; the magnetic induction intensity of the fifth group of permanent magnets is 0.31-0.75 T, and a width of the fin group of permanent magnets in the travel direction of the blank is 0.5-1.0 m.

5. The method of claim 1, wherein when the static magnetic field is generated by the three groups of permanent magnets, the permanent magnets are U-shaped magnets or circular magnets; for the U-shaped magnets, the longitudinal center line of the blank is aligned with a center line of a notch of each U-shaped magnet; and for the circular magnets the longitudinal center line of the blank is aligned with a center of each circular magnet.

* * * * *